US005483708A

United States Patent [19]

Binfare'

[11] Patent Number: 5,483,708

[45] Date of Patent: Jan. 16, 1996

[54] SOFA BED WITH VARIABLE-POSITION BACK

[75] Inventor: Francesco Binfare', Monza, Italy

[73] Assignee: Edra S.P.A., Perignano, Italy

[21] Appl. No.: 184,504

[22] Filed: Jan. 19, 1994

[30] Foreign Application Priority Data

Jan. 19, 1993 [IT] Italy ..... PT93A0002

[51] Int. Cl.[6] ..... A47C 17/04

[52] U.S. Cl. ..... 5/12.1; 5/2.1; 297/118; 297/353

[58] Field of Search ..... 5/12.1, 24, 26.1, 5/2.1; 297/353, 118

[56] References Cited

FOREIGN PATENT DOCUMENTS

8806984 U 9/1988 Germany .

8901762 U 4/1989 Germany .

9112885 U 1/1992 Germany .

*Primary Examiner*—Alexander Grosz

*Attorney, Agent, or Firm*—Herbert Dubno

[57] ABSTRACT

A sofa or bed structure has a seat and a variable-setting back and has a device for coupling the seat frame together with legs and a back set. The device is made up of a plate having a seat for the rotational coupling with the seat frame and a coaxial pivot insertable into a bush integral with a radial structure fixed to supporting legs. A restrainer on the seat frame ensures the stability of the position reached. The combination allows the seat frame and back to assume a wide variety of positions, through rotation of the seat frame in relation to the back set or through moving of the back set in relation to the seat frame.

5 Claims, 5 Drawing Sheets

SOFA BED WITH VARIABLE-POSITION BACK

SUMMARY OF THE INVENTION

According to the present patent, a sofa bed frame, whether involving upholstered or non-upholstered units, has a seat frame joined to a mechanical device that enables the seat frame to assume different positions in relation to the back, or the back in relation to the seat frame. This is achieved by the reciprocal rotation of the seat frame and back and rotation in respect to the supporting legs. Furthermore, the same supporting structure makes it possible to benefit from two types of back, namely one with a variable setting and one with a fixed body, located in a straight line in one case and at an angle in the other case. As will become more clearly apparent later, the construction allows a wider variety of connections between the two types of units and makes it possible to obtain different combinations.

According to the present invention the device for coupling the seat frame together with legs and the back is made up of a plate having a seat for rotational coupling with the seat frame and a coaxial pivot insertable into a bush integral with a radial structure fixed to the supporting legs. Restraining means, integral with the seat frame, is provided stabilizing the position reached. The combination allows seat frame and back to assume a wide variety of positions, through rotation of the seat frame in relation to the back or through movement of the back in relation to the seat frame.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
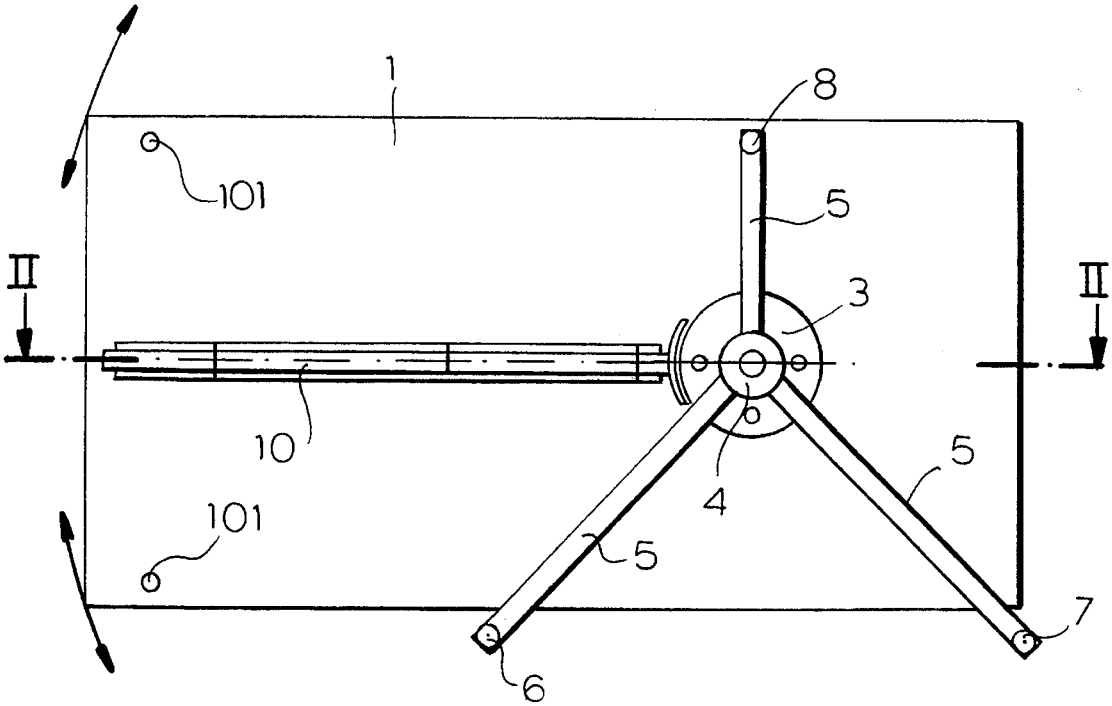
FIG. 1 is a diagrammatic bottom plan view of a sofa bed frame according to the invention.

FIG. 1 illustrates, albeit in a schematic manner, a view of the underside of the sofa seat or bed frame in an embodiment of the invention wherein a fixed part of the back set lies in a straight line.

Figure 2:
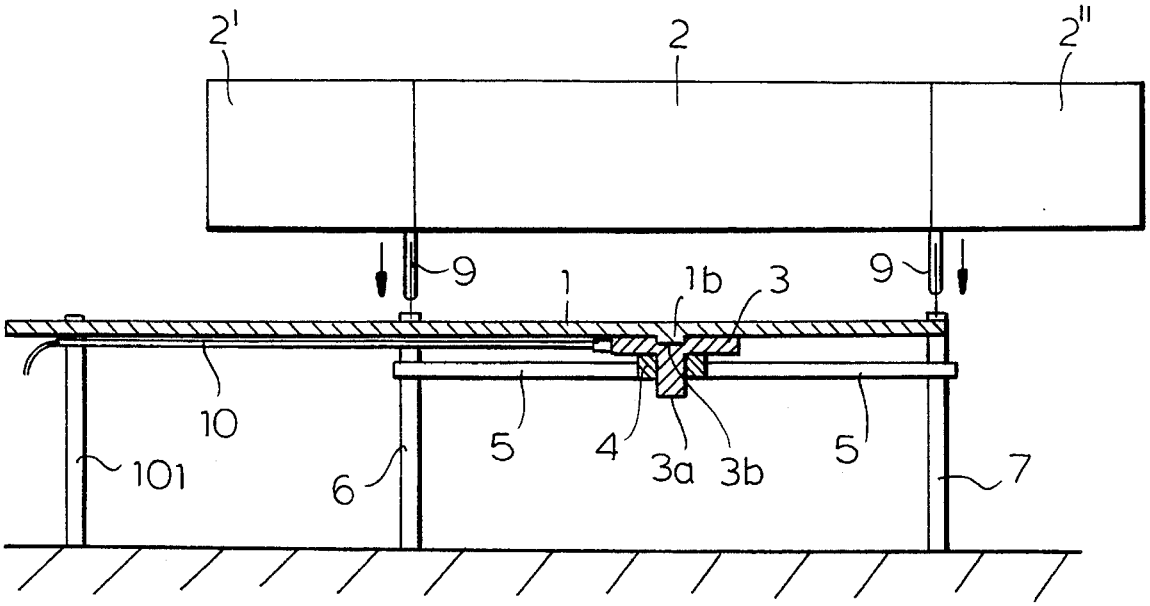
FIG. 2 is a sectional view along line II—II of FIG. 1 showing assembly of a back to the frame.

FIG. 2 represents the longitudinal section of FIG. 1.

Figure 3:
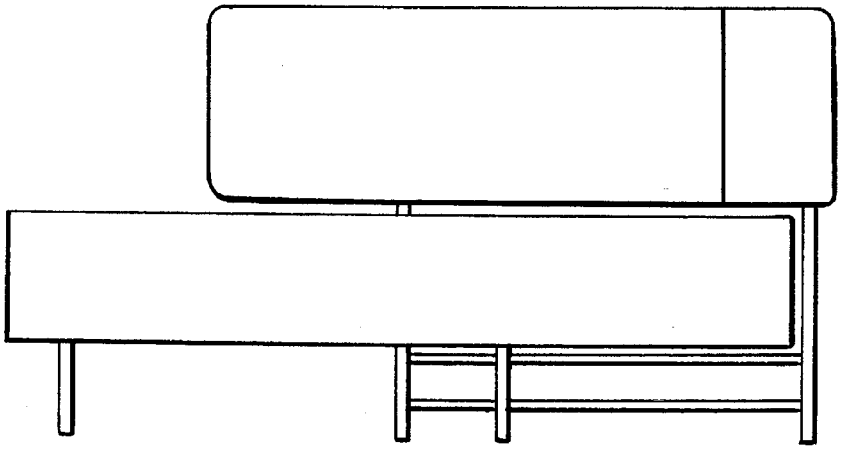
FIG. 3 is an elevational view of the assembled article.
Figure 4:
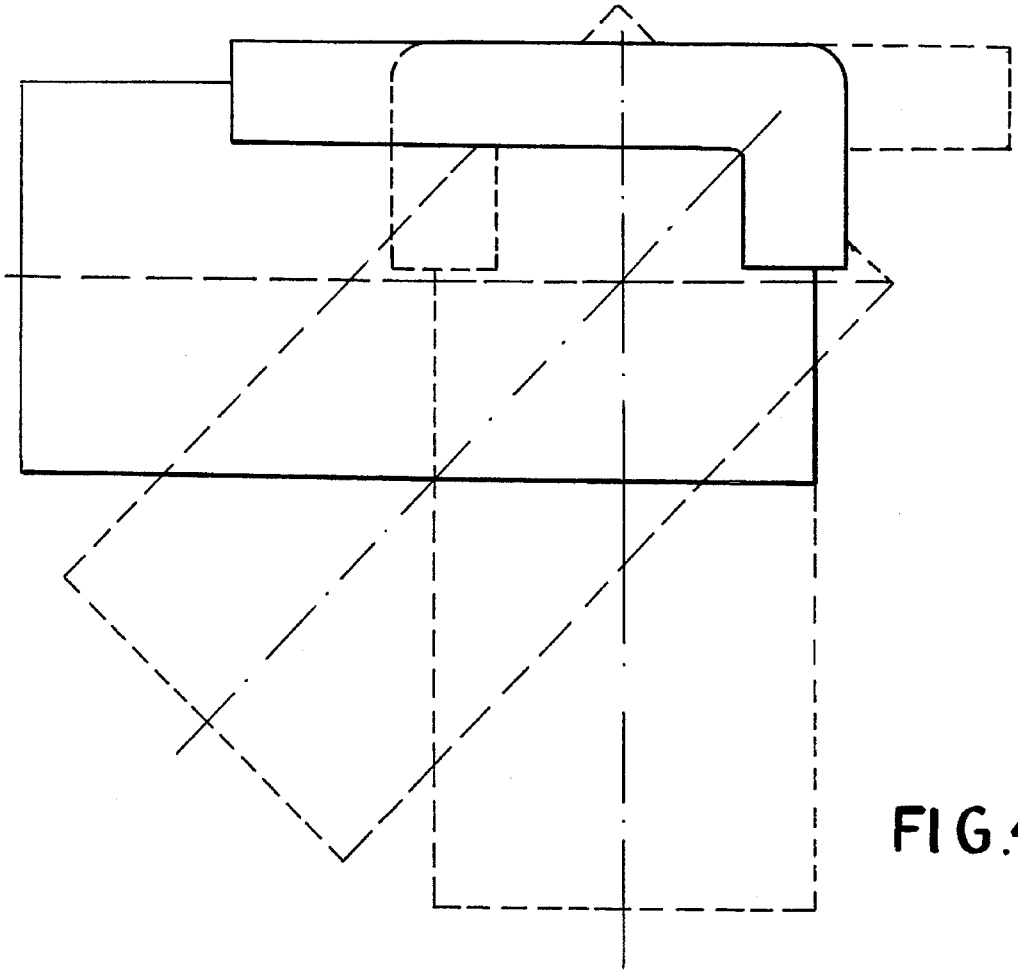
FIG. 4 is a plan view showing various relative positions of the parts.

FIGS. 3 and 4 show the unit, in an upholstered version, seen from the front and in plan view, with dotted outlines in two positions between those which may be assumed by seat frame in relation to the back and the various settings capable of being attained by such back.

Figure 5:
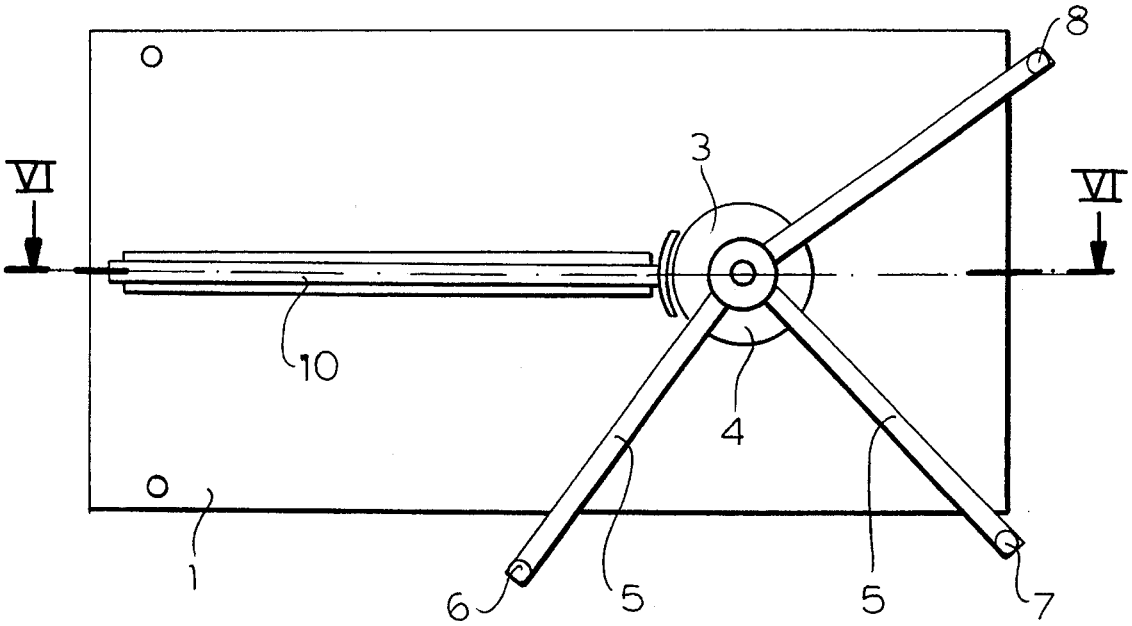
FIG. 5 is another bottom view.
Figure 6:
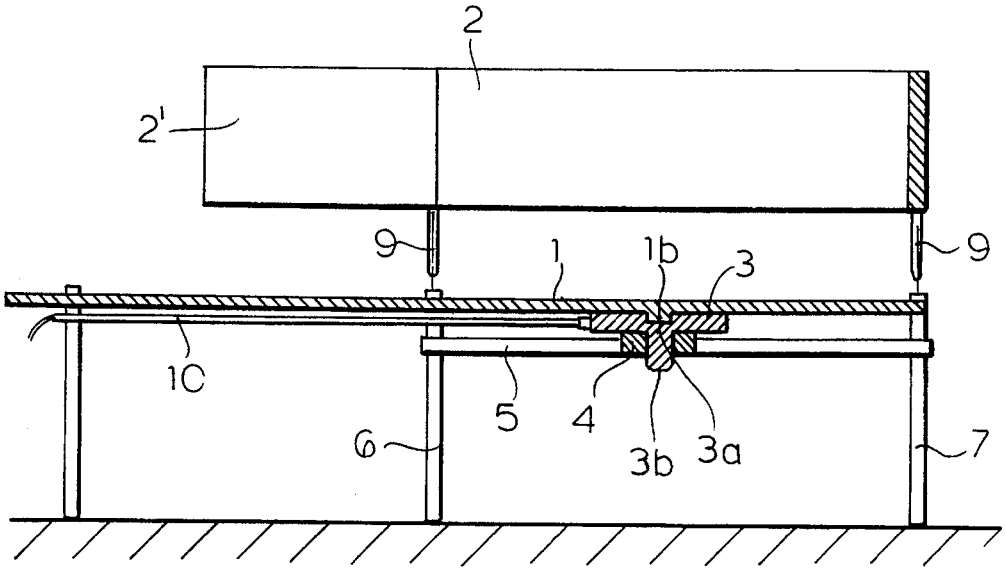
FIG. 6 is a view similar to FIG. 2 illustrating another feature of the invention.

FIGS. 5 and 6 show a different configuration of the sofa according to the invention seen from the bottom and in a longitudinal section respectively.

Figure 7:
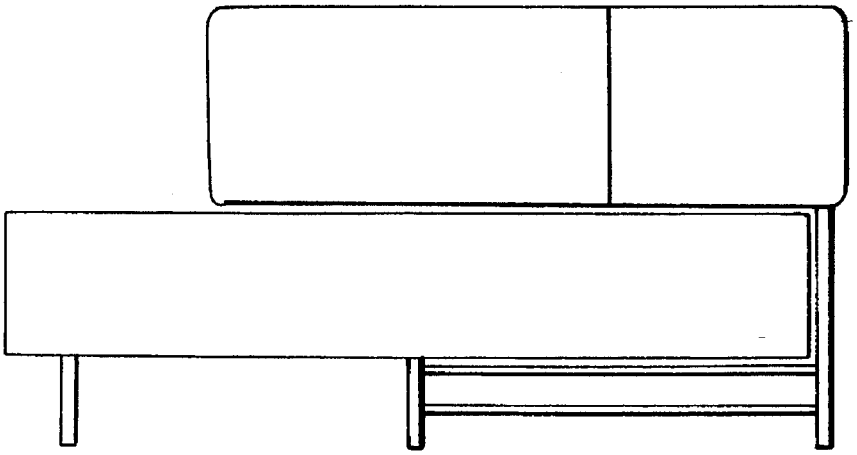
FIGS. 7 and 8 are views corresponding to FIGS. 3 and 4.
Figure 8:
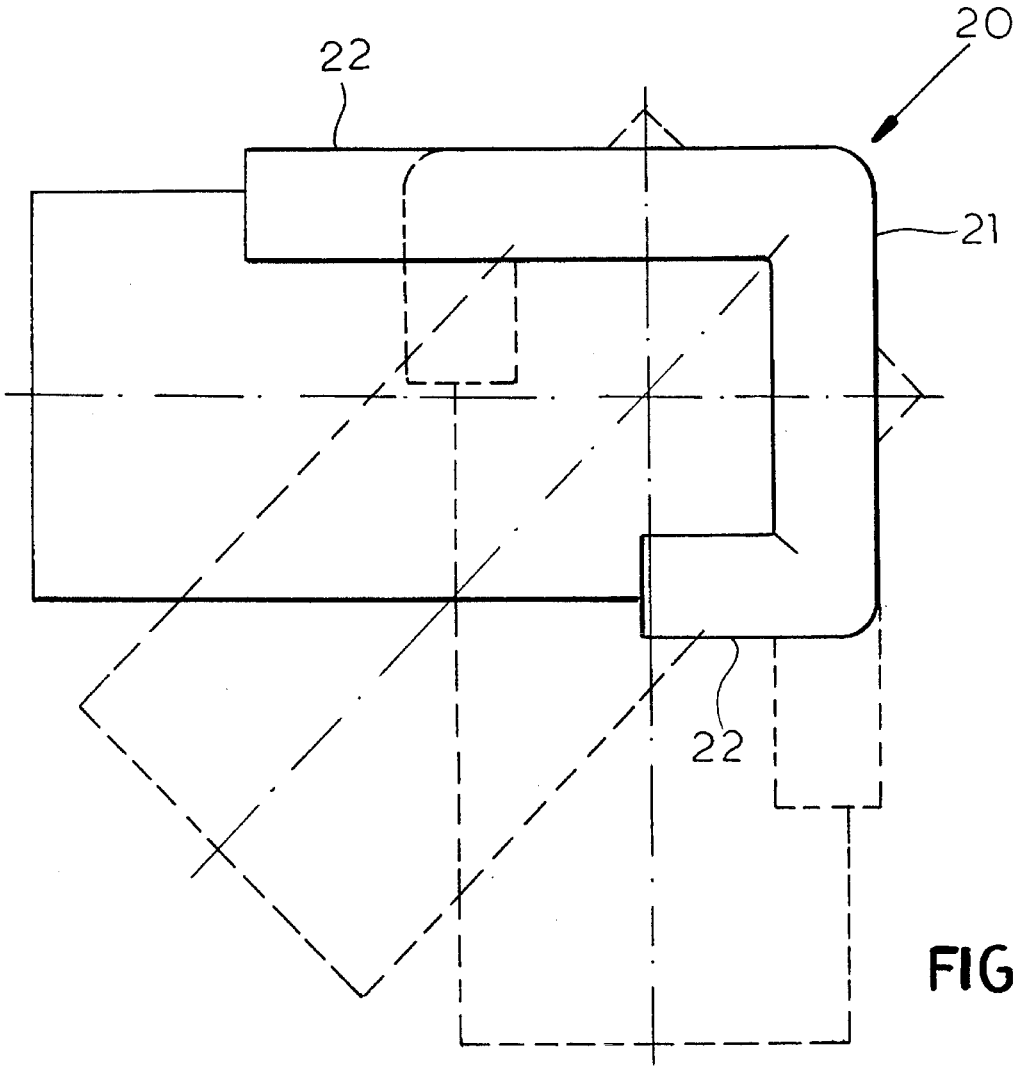

FIGS. 7 and 8 are views of different configuration of the sofa of FIGS. 5 and 6 while FIGS. 9 to 19 illustrate other arrangements of the different parts of the sofa.

More specifically FIG. 1 shows the seat frame 1 supported at one end by normal legs 101 extending to the floor, and at the other end by a radial structure of arms 5 provided with supporting legs 6, 7, 8. The radial structure 5 is integral with the seat frame through a device allowing reciprocal movement of seat frame 1 and a back set 2. The device consists of a plate 3 with a pivot 3*a* which engages a bush 4, made integral with radial structure 5 whose arms 5*a* are connected to the three legs 6, 7 and 8. The plate 3 is further provided with a seat 3*b*, coaxial with the pivot 3*a*, into which a corresponding pin 1*b* of the seat frame 1 enters. In this way the radial structure 5 and the plate 3 are fixed while the seat frame 1 can rotate relatively to the plate 3 itself whose upper surface can have a finish with a low coefficient of friction to facilitate the rotation.

Legs 6 and 7 are located outside the outline of the seat frame 1, they are tubular and are such as to allow the insertion of pins 9 (FIG. 2) of the back 2 for fixing the back to such legs. Back 2 is rectilinear setting in its middle part, while end parts 2' and 2" may rotate through 90 degrees in both directions. This is made possible by the presence of internal hinges for the attachment of the end parts to the middle part.

A restraining device affixed to the seat frame 1 imparts stability to the structure once it has assumed the desired position having an element 11 drivable from outside the seat frame 1 for preventing further rotation of the seat frame 1 relative to the radial structures.

Figure 9:
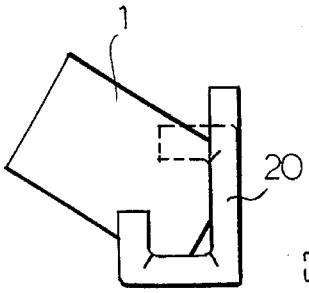
FIGS. 9–19 are diagrammatic plan views showing various positions of the article of furniture.
Figure 19:
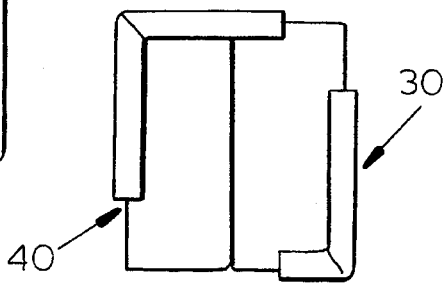

In the embodiment of FIGS. 5 and 6 it is the radial structure 5, integral with back 2, which remains fixed, whereas it is the seat frame 1 which undergoes movement. Nothing prevents the opposite from occurring, it being sufficient for this purpose to modify the supports 6, 7, 8 of the seat frame 1. FIGS. 5, 6, 7 and 8 correspond to the drawings described above, with the sole difference that the back 20 has its fixed part 21 at an angle. The broken lines show the various positions of the hinged parts 22 of the back (FIG. 8). All three legs 6, 7 and 8 are located outside the perimeter of the seat frame 1 and serve for the attachment of back 2 to the legs integral with the radial structure 5. In FIGS. 9 and 19 are shown some combinations of possible dispositions of the back set, having different shapes, with seat frame under different positions.

Figure 10:
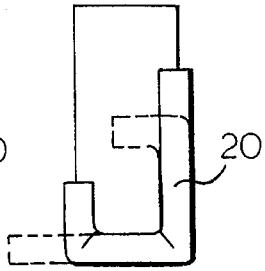
Figure 11:
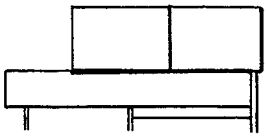

In FIG. 9, for example, the back 20 is not aligned with sides of the seat frame 1 whereas in FIG. 10, as in FIG. 8, the back 20 is aligned with the sides of the seat frame. FIG. 11 shows the latter article from the side.

Figure 12:
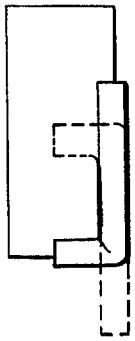
Figure 13:
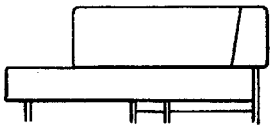
Figure 14:
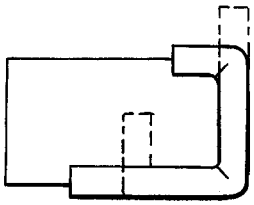
Figure 15:
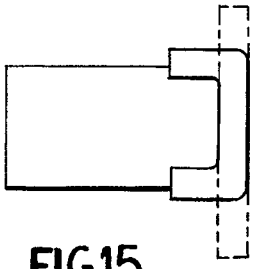
Figure 16:
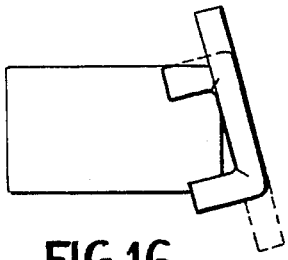
Figure 17:
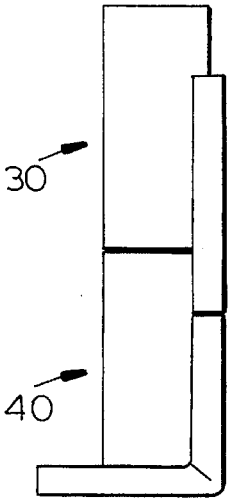
Figure 18:
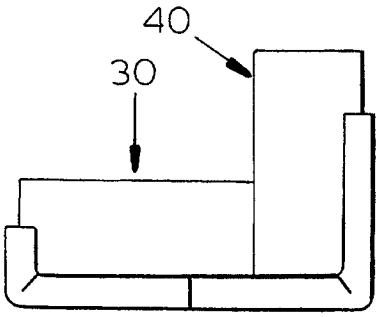

FIGS. 12 and 13 correspond to FIGS. 3 and 4 while FIGS. 14 and 15 show other configurations of the embodiments of FIGS. 8 and 3, respectively. FIG. 16 shows a variant of FIG. 15 wherein the back 2 does not lie along an edge of the seat frame. FIGS. 17, 18 and 19 show two furniture units 30 and 40 corresponding to the unit of FIG. 3 and the unit of FIG. 8, respectively, in various combinations.

I claim:

1. An article of furniture comprising:

an elongated seat member formed at one end with support legs;

a radial structure rotatable on an underside of said seat member and spaced from said one end, said radial structure comprising a plate having a downwardly extending pin, a bush receiving said pin, a plurality of angularly spaced radial arms extending away from an axis of said pin and said bush, and respective legs on said arms extending downwardly therefrom, at least two of said arms having ends projecting beyond an outline of said seat member;

a back member mounted on said ends of said arms whereby, upon relative rotation of said seat member and said radial structure, said seat and back members can assume a wide variety of positions; and restraining means on said seat member engage able with said radial structure for stabilizing said seat and back members in a selected one of said positions.

2. The article of furniture defined in claim 1 wherein said restraining means comprises a frictional element mounted on said seat member and drivable from outside of said seat member radially relative to said plate for restraining rotation of the seat member relative to said radial structure.

3. The article of furniture defined in claim 1 wherein said back member has a fixed rectilinear middle part and end parts rotatable through 90° relative to said middle part.

4. The article of furniture defined in claim 1 wherein said back member has two fixed parts forming a right angle with one another and at least one end part rotatable through 90° relative to said fixed parts.

5. The article of furniture defined in claim 1 wherein said back member has pins axially engageable in respective seats of said legs on said ends of said arms.

* * * * *